US007069668B1

(12) United States Patent
Volker et al.

(10) Patent No.: US 7,069,668 B1
(45) Date of Patent: Jul. 4, 2006

(54) PORTABLE TANK AND PROCESS FOR DRYING HYGROSCOPIC MATERIALS

(75) Inventors: George Murray Volker, Vienna, WV (US); Leo Michael Lech, Washington, WV (US)

(73) Assignee: E.I. du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 11/054,866

(22) Filed: Feb. 10, 2005

(51) Int. Cl.
*F26B 13/10* (2006.01)

(52) U.S. Cl. ..... 34/582; 34/586; 34/587; 34/201; 366/101

(58) Field of Classification Search ..... 34/576, 34/577, 582, 583, 586, 587, 201, 218; 220/565, 220/581; 366/101
See application file for complete search history.

(56) References Cited

U.S. PATENT DOCUMENTS

| | | | | |
|---|---|---|---|---|
| 4,258,953 | A | 3/1981 | Johnson | |
| 4,384,960 | A | 5/1983 | Polley | |
| 4,836,421 | A * | 6/1989 | Miyoshi et al. | 222/166 |
| 5,704,967 | A | 1/1998 | Tom et al. | |
| 6,354,465 | B1 | 3/2002 | Bell et al. | |
| 6,463,675 | B1 * | 10/2002 | Hansen et al. | 34/583 |
| 6,558,111 | B1 | 5/2003 | Wilson et al. | |

FOREIGN PATENT DOCUMENTS

| | | |
|---|---|---|
| JP | 61025085 | 2/1986 |
| JP | 05112387 | 5/1993 |
| RU | 2194020 | 12/2002 |
| ZA | 7704469 | 10/1978 |

* cited by examiner

*Primary Examiner*—Jiping Lu

(57) ABSTRACT

A transportable portable tank for storing, transporting and drying a hygroscopic material and a transportable portable tank assembly. The portable tank comprises an upper, a middle and a lower region. The upper region comprises a materials inlet, a gas inlet and a gas outlet. The middle region comprises a gas disperser. The lower region comprises a materials discharge outlet. The portable tank has a capability to effectively remove and/or exclude moisture and a capability to effectively break up agglomerates of caked hygroscopic material, such as iodine. The present invention further provides a process for drying a hygroscopic material such as iodine within a portable tank.

22 Claims, 2 Drawing Sheets

FIG. 4
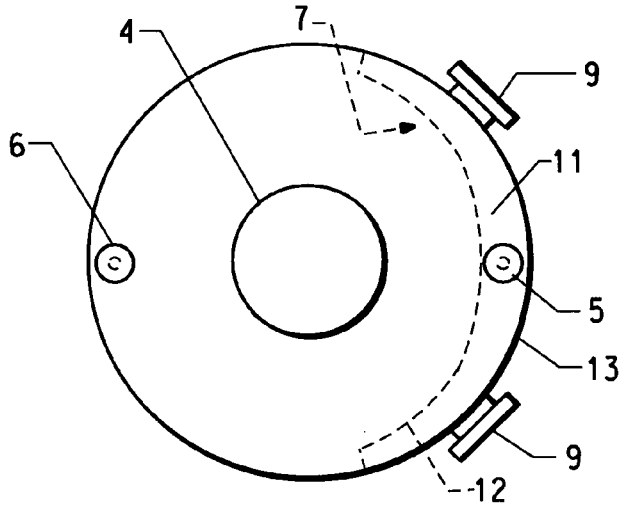
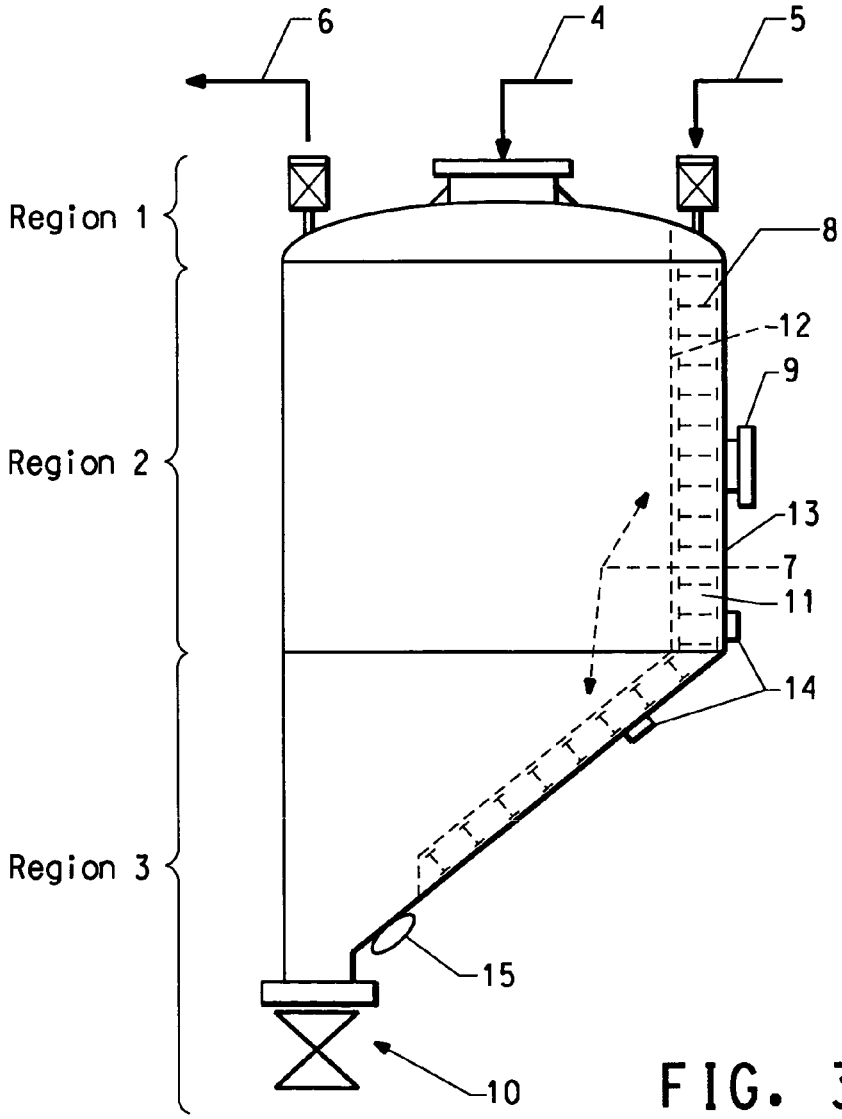
FIG. 3

PORTABLE TANK AND PROCESS FOR DRYING HYGROSCOPIC MATERIALS

FIELD OF THE INVENTION

This invention relates to a portable tank assembly. This invention also relates to a process for drying iodine.

BACKGROUND OF THE INVENTION

Iodine is generally handled in the form of prills, flakes, crystals, lumps, powder or grain made by solidifying a melt of iodine by cooling.

Because of the hygroscopic nature of iodine, iodine in the above noted forms readily picks up moisture from ambient air. Moisture that enters a container for transportation of iodine promotes caking or bridging that prevents free flow of the iodine. The presence of moisture in the iodine may be an issue for use of the iodine in processes sensitive to the presence of water. Such processes may need to incorporate additional steps to dry the iodine.

Iodine is a dense material, with a tendency to tightly pack when stored. The tendencies of iodine to both cake (due to moisture) and pack, and especially the combination of these two properties, can make it difficult to unload and empty a container of iodine.

Containers for bulk packaging and transporting iodine are known. Such containers suffer from numerous deficiencies. For example, many containers do not have the capacity for amounts of iodine over 1200 pounds. Many containers are non-recyclable, generating waste for every shipment. Many containers are ineffective at excluding moisture, resulting in caking of the iodine within the container.

U.S. Pat. No. 4,836,421, discloses a container for iodine that is a transportable portable tank and frame assembly. The portable tank and frame are positionable in an upright or a reclined position. The portable tank includes a side wall, a cover body located at a top end portion of the side wall when the tank is in the upright position, a discharging port formed in a lower portion of the tank, and a rotatable paddle plate positioned in the discharge port so as to promote discharge of material confined within the tank.

While the transportable portable tank and frame described in U.S. Pat. No. 4,836,421, provides for bulk transporting of iodine, it too suffers from deficiencies. For example, the tank does not exclude moisture and moisture can easily enter and contact iodine therein. The collected moisture causes caking to occur, which makes it difficult to unload iodine from the tank. Unloading iodine that has caked along the side wall upon which the portable tank lies during storage and transportation is particularly difficult. Additionally, for applications that are very sensitive to water content in the iodine, collected moisture causes operating problems that may be unique to such applications.

The tank described in U.S. Pat. No. 4,836,421, also does not provide a means to effectively break up agglomerates of caked iodine. In particular, the rotatable paddle plate positioned near the discharge port does not break up caked iodine that has accumulated along the side walls.

Therefore, it is desirable to have a transportable container assembly, suitable for iodine, with a capability to effectively remove and/or exclude moisture and a capability to effectively break up agglomerates of caked iodine that accumulate on the side walls. The present invention meets these needs.

SUMMARY OF THE INVENTION

The present invention provides a container that is a portable tank especially a portable tank that fits a frame assembly for storing, transporting and drying a hygroscopic material. The portable tank of this invention has a capability to effectively remove and/or exclude moisture and a capability to effectively break up agglomerates of caked hygroscopic material, such as iodine. The present invention further provides a process for drying a hygroscopic material such as iodine within a portable tank.

BRIEF DESCRIPTION OF THE DRAWING(S)

This invention will now be described with reference to the drawings wherein:

FIG. 3 is a side view of an alternative embodiment of the portable tank of this invention.

FIG. 4 is a top view of an alternative embodiment of the portable tank of this invention.

DETAILED DESCRIPTION OF THE INVENTION

The present invention is directed to a portable tank for transporting bulk solid material, such as hygroscopic solids, and is particularly suitable for storing and transporting iodine. The present invention is also directed to a method for drying iodine within a portable tank.

The portable tank of this invention is an improvement on the portable tank and frame assembly described in U.S. Pat. No. 4,836,421, the teachings of which are incorporated herein by reference.

The portable tank of this invention can be constructed of any suitable material and is typically constructed of a synthetic resin. More specifically, the synthetic resin should be inert. The portable tank should be capable of withstanding internal pressure of at least 5 psig, preferably 20 psig, and as high as 50 psig.

Figure 1:
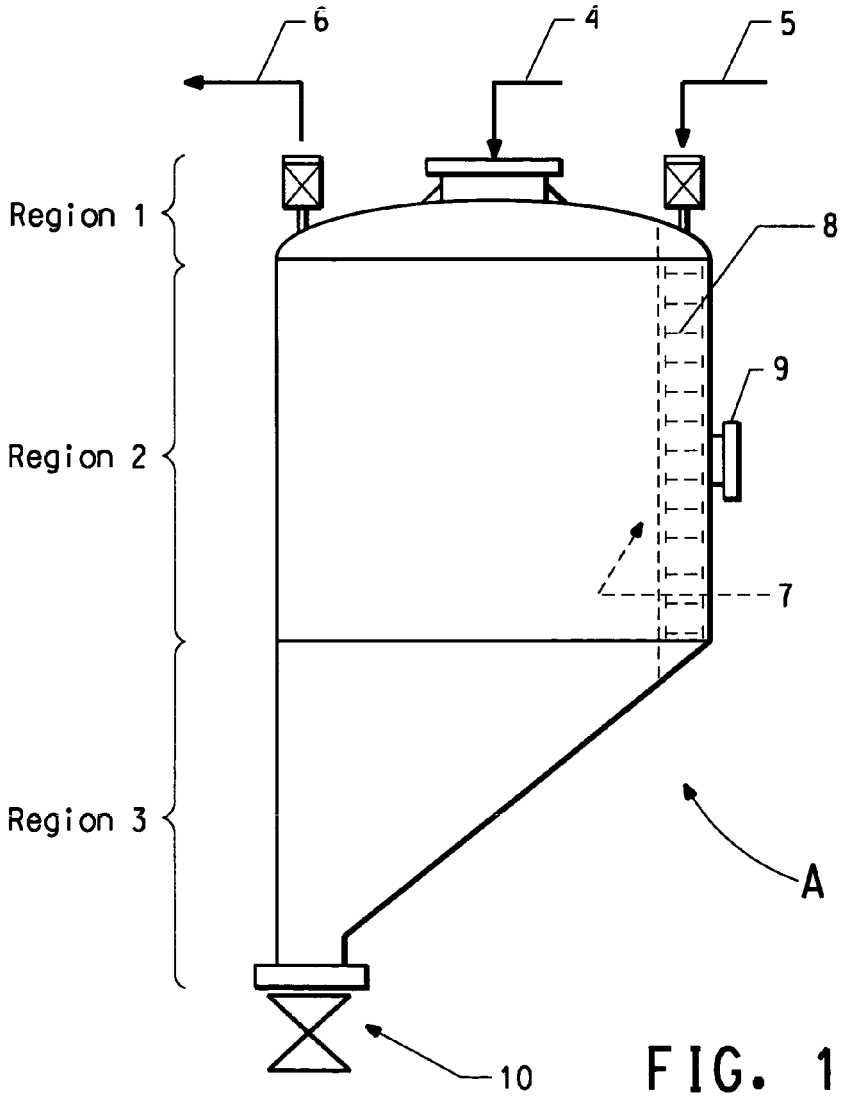
FIG. 1 is a side view of one embodiment of the portable tank of this invention.

One embodiment of the portable tank of this invention is shown in FIG. 1. Shown at A is a side view of a portable tank of this invention. The portable tank comprises an upper region 1, a middle region 2, and a lower region 3. The upper region 1 is a cover body, generally circular in shape, which serves as a sealing cover adjacent to and attached to middle region 2 of the portable tank. The middle region 2 and lower region 3 each comprise side walls and these regions are either continuous or connected such that the combination of the middle and lower regions defines a cavity. The middle region 2 is generally cylindrical in shape.

A materials inlet 4 is an opening in the central region of the cover body, extending through the cover body to provide; for example, an iodine inlet, if the portable tank is charged with iodine. The portable tank is filled with material through the materials inlet 4. Upper region 1 further comprises a first peripheral opening and a second peripheral opening wherein these openings are provided at the periphery of the cover body. Attached to the first peripheral opening is a gas inlet 5 which extends through the cover body. The gas inlet 5 permits gas to enter the portable tank cavity. Attached to the second peripheral opening is a gas outlet 6, which extends through the cover body. The gas outlet 6 allows gas to exit the portable tank. The gas outlet 6 is preferably at an opposite position of the cover body from the gas inlet 5, for example, at about 180° offset from the gas inlet 5. Although not shown, each of the openings in the upper region 1, that is, the materials inlet the first peripheral opening and the second peripheral opening, are constructed such that they comprise nozzles, flanges, and valve assemblies that meet the rated design pressure of the vessel and further comprise tight seals in order to exclude vapors, such as moist air, from entering the portable tank.

The design and attachment of the cover body to middle region 2 of the portable tank is such that the portable tank design pressure can be met. The cover body can be a rounded head or flat. If the cover body is flat, it should be provided with reinforcement to achieve strength to meet the design pressure.

The gas inlet 5 connects into a gas disperser 7 which is positioned within the cavity defined by the middle and lower regions along the internal side wall of middle region 2 and may extend beyond middle region 2 into lower region 3. This gas disperser 7 can be, for example, a sieve tray or similar device for dispersing a dry, inert gas, such as nitrogen or dry air into the contents of the portable tank. The gas disperser 7 extends along the side wall of middle region 2 typically for about 25% to about 50% of the circumference of region 2. The gas disperser 7 is constructed with a plurality of support rests 8 positioned intermittently along the length of gas disperser 7. The support rests 8 have sufficient strength to support the weight of the iodine or other material contained within the portable tank.

Along the side wall of middle region 2 and mounted into said side wall adjacent to the gas disperser 7 is a clean out port 9. The purpose of the clean out port 9 is to facilitate cleaning of the portable tank in and around the gas disperser 7. One or more clean out ports 9 may be present. Cleaning may be desired or needed if iodine or other material becomes trapped in the openings of the gas disperser 7.

Positioned at the lower end, that is the end opposite of region 2 of the lower region 3 of the portable tank is a discharge outlet 10, for example an iodine outlet if the portable tank has been charged with iodine, through which material exits the portable tank.

Figure 2:
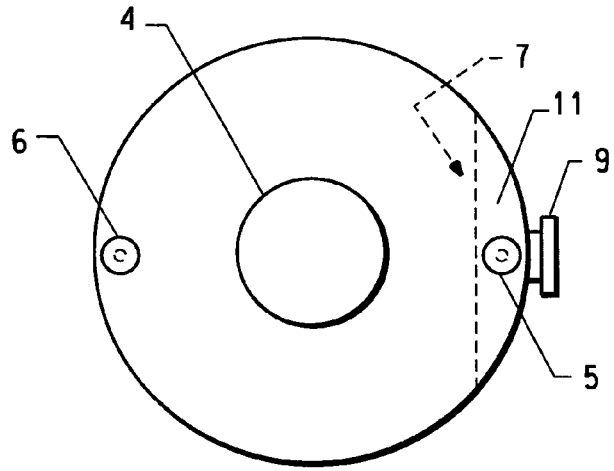
FIG. 2 is a top view of one embodiment of the portable tank of this invention.

Shown at FIG. 2 is a top view of a portable tank of this invention. From this view can be seen the top of the cover body of region 1 of the portable tank of FIG. 1. In the center of the portable tank in FIG. 2 is shown an opening which provides the material inlet 4, preferably, an iodine inlet. To the right is shown a first peripheral opening, which is the gas inlet 5. To the left is shown a second peripheral opening, which is the gas outlet 6.

The dotted line in FIG. 2 indicates the location in this embodiment of the gas disperser 7 which is positioned along the internal side wall and forms a chord section as a flat tray. Also shown is a clean out port 9 which is mounted into side wall of middle region 2 and adjacent to the gas disperser 7. The chord section and outer wall are separated to define a gas region 11 which is connected to the gas inlet 5 at its upper end.

An alternative embodiment is shown in a side view in FIG. 3. As in FIG. 1, the portable tank comprises an upper region 1, generally circular in shape, a middle region 2, generally cylindrical in shape, and a lower region 3. The middle region 2 and lower region 3 each comprise side walls and these regions are either continuous or connected such that the combination of the middle and lower regions define a cavity.

Disposed within the middle region 2 is a gas disperser 7. Gas disperser 7 is positioned within the cavity defined by the middle and lower regions and along the internal side wall of middle region 2. In this embodiment, the gas disperser 7 extends along side walls of region 2 into region 3.

In the embodiment shown in FIG. 3, gas disperser 7 is defined by two parallel walls, an inner parallel wall 12 and an outer parallel wall 13, along the length of a portion of the side wall of region 2. The parallel walls preferably extend along 25% to 50% of the circumference of region 2. The inner parallel wall 12 faces the inside of the portable tank and is exposed to the portable tank contents. The outer parallel wall 13 is a portion of the side wall of region 2, and, in this embodiment, also a portion of the side wall of region 3, as the gas disperser 7 extends below region 2 into region 3. The two parallel walls are separated to define a gas region 11 between the walls. The gas inlet 5 connects into the gas region 11 at its upper end. The inner parallel wall 12, that is, the segment facing the inside of the portable tank and its contents, for example wherein the contents comprise iodine, comprises perforations of a size and pattern through which dry gas from the gas inlet 5 is dispersed into the contents of the portable tank. The size and pattern of the perforations should be designed to prevent iodine or other contents of the portable tank from entering the gas region 11 between the two parallel walls and to effectively disperse the gas.

The gas disperser 7 is constructed with support rests 8 with sufficient strength to support the weight of the iodine or other material contained within the portable tank. Pressure rated flanges with covers, which provide clean out ports, shown at 9, provide access to the gas region 11 between the inner parallel wall 12 and the outer parallel wall 13. The clean out ports 9 should be designed to withstand the pressure rating of the portable tank.

Optionally attached to the outside of the walls of region 2 are support brackets 14. The number of support brackets 14 will generally range from 0 to 3. Support brackets 14 are provided for optional attachment of one or more vibrator or sonicator devices (not shown) to the portable tank. These devices may be used to aid the break up of caked (agglomerated) iodine that does not flow toward the discharge outlet 10.

Upper region 1 defines the cover body of the portable tank. In the portable tank shown in FIG. 3 both the inner parallel wall 12 and outer parallel wall 13 are sealed to the cover body. An opening is located in the central region of upper region 1 to provide a materials inlet 4 through which material, such as iodine, can be charged to the portable tank. The materials inlet 4 comprises a flange further comprising a bolted cover that is designed and rated for the desired pressure of the tank.

Two additional openings 5 and 6 are provided in the cover body, upper region 1. Openings 5 and 6 are fitted with connection assemblies comprising flanged joints and valves. Openings 5 and 6 and their connection assemblies are designed and rated for the desired design pressure of the portable tank. Openings 5 and 6 are preferably located approximately 180° apart from each other on the generally circular cover body. Opening 5 is the gas inlet and is opened into and connected therewith the gas region defined by the separation of the parallel walls. Opening 6 is a gas outlet and provides for venting of gas admitted into the portable tank through the gas inlet, through the gas disperser 7 and through the contents of the portable tank.

Region 3 defines the lower end of the portable tank and is continuous with or connected to region 2. Region 3 has the general design of an offset cone. The cone is offset such that the discharge outlet 10 is located on the periphery of cylindrical region 2 and so that it is on the opposite side from the gas disperser 7 as is shown in FIG. 3. The cylinder double wall section of region 2 may be sealed at the connection to the offset cone, such as shown in FIG. 1, or alternatively, the double wall may be extended and sealed into the offset cone section of region 3, as shown in FIG. 3.

Optionally attached to the outside of the walls of region 3 are support brackets 14. The number of support brackets 14 will generally range from 0 to 3. Support brackets 14 are provided for optional attachment of one or more vibrator or sonicator devices (not shown) to the portable tank as may be provided in region 2.

Positioned at the narrow (lower) end of region 3 is a discharge outlet 10. The discharge outlet 10 comprises a flange and valve assembly designed and rated for the desired pressure of the portable tank. The flange on discharge outlet 10 is sized as needed for discharge of the material contained within the portable tank. The valve can be any suitable design that meets the pressure rating. Preferably the valve is a sliding gate valve, a ball valve, or a plug-type valve. These valves are preferred because they can be opened and closed even if a column of solid iodine is directly above the valve.

Furthermore, one or more gas sparge nozzles 15 may be mounted on the side walls of region 3 and extend through the walls and into the portable tank to aid dispersion of dry gas into the portable tank or to aid in moving material particles to discharge outlet 10.

Shown at FIG. 4 is a top view of an alternative portable tank of this invention. From this view can be seen the top of the cover body of region 1 of the portable tank of FIG. 1 or FIG. 3. In the center of the portable tank in FIG. 4 is shown an opening, which provides the materials inlet 4. To the right is shown an opening, at the periphery, which is the gas inlet 5. To the left is shown a second opening at the periphery, which is the gas outlet 6.

The dotted line in FIG. 4 indicates the location in this embodiment of the gas disperser 7, which is positioned along the internal side wall and is curved, that is, forms an arc of a circle of smaller diameter than the cover body. The gas disperser 7 is defined by an inner parallel wall 12 and an outer parallel wall 13. The inner parallel wall 12 and outer parallel wall 13 are separated by a distance to provide a gas region 11. The curved shape of the gas disperser 7 allows the purge gas to contact a larger portion of the portable tank content to facilitate purge to reduce moisture.

Also shown in FIG. 4 are two clean out ports 9, which are mounted into the side wall of middle region 2 and adjacent to the gas disperser 7.

The portable tank of the present invention may be conveniently used with the tank, frame and body as substantially described in U.S. Pat. No. 4,836,421. Other equivalent or alternative designs may also be used.

The present invention further provides a method to dry iodine comprising (a) providing a portable tank (as broadly claimed) wherein the contents of the portable tank comprise iodine contaminated with water; (b) introducing a dry gas into the portable tank through the gas inlet and gas disperser; and (c) discharging gas from the portable tank through the gas outlet. Preferably the iodine water concentration in the portable tank after drying is less than 0.02% based on the combined weights of iodine and water.

Any dry gas can be used so long as it is inert to the iodine, water and preferably inert to subsequent materials with which the iodine will react. Conveniently, the dry gas is dried air, nitrogen, or mixtures thereof.

While this invention has been described in terms of the specific embodiments as described above, it is with the understanding that the present disclosure is to be considered as an exemplification of the principles of the invention and is not intended to limit the invention to the embodiments illustrated. Obviously, numerous modifications and variations of the present invention are possible in light of the above teachings.

EXAMPLE

This Example demonstrates the ability to dry iodine using a low flow of an inert gas.

To a drying tube was added 300 grams of iodine. The iodine was purged with nitrogen for 60 minutes at a temperature of about 65° C. Moisture level after the nitrogen purge was less than about 200 ppm, the detection limit, as measured using a KJT-200 Near Infrared Moisture Analyzer (available from Zeltex Inc., Hagerstown, Md.).

The nitrogen-purged iodine as prepared above was spiked with 6,666 ppm of water, and rolled to evenly distribute the water. The wet iodine was placed in a plastic drying tube, which was purged with warm nitrogen at a flow rate of about 215 sccm (standard cubic centimeters per minute) for various periods of time ranging from 240 to 15 minutes. After drying, the iodine was re-analyzed for moisture. No moisture was detected at the lower detection limit of about 200 ppm. Furthermore, in this flow experiment, no noticeable loss of iodine was observed.

These results indicate that an inert gas flow, such as nitrogen, through a wet iodine solid is effective at removing moisture without significant loss of iodine through sublimation.

What is claimed is:

1. A portable tank comprising an upper region, a middle region and a lower region wherein (a) the upper region is a cover body adjacent to and attached to the middle region and comprises an opening in the central region to provide a materials inlet; a first peripheral opening and a second peripheral opening provided at the periphery of the cover body wherein a gas inlet is attached to the first peripheral opening and a gas outlet is attached to the second peripheral opening and further wherein the gas inlet and gas outlet extend through the cover body;

(b) the middle region and the lower region each comprise side walls and are continuous or connected such that the combination of the middle and lower regions define a cavity;

(c) the middle region comprises a gas disperser connecting with the gas inlet, positioned within the cavity defined by the middle and lower regions along the internal side wall of the middle region wherein the gas disperser is constructed with a plurality of support rests positioned intermittently along the length of the gas disperser; and a clean out port mounted into the side wall of the middle region adjacent to the gas disperser; and (d) the lower region comprises a materials discharge outlet at its lower end.

2. The portable tank of claim 1 wherein the portable tank is capable of withstanding internal pressure of at least 5 psig.

3. The portable tank of claim 2 wherein the portable tank is capable of withstanding internal pressure of at least 20 psig.

4. The portable tank of claim 1 wherein the gas outlet is provided at about 180° from the gas inlet.

5. The portable tank of claim 1 wherein the gas disperser extends beyond the middle region into the lower region.

6. The portable tank of claim 5 wherein the gas disperser is a sieve tray.

7. The portable tank of claim 5 wherein the gas disperser extends along the side wall for about 25% to about 50% of the circumference of the middle cylindrical region.

8. The portable tank of claim 5 wherein the gas disperser forms a chord.

9. The portable tank of claim 5 wherein the gas disperser is curved.

10. A portable tank comprising an upper region, circular in shape, a middle region, cylindrical in shape and a lower region wherein (a) the upper region is a cover body adjacent to and attached to the middle region and comprises an opening in the central region to provide a materials inlet; a first peripheral opening and a second peripheral opening provided at the periphery of the cover body wherein a gas inlet is attached to the first peripheral opening and a gas outlet is attached to the second peripheral opening and further wherein the gas inlet and gas outlet extend through the cover body;

(b) the middle region and the lower region each comprise side walls and are continuous or connected such that the combination of the middle and lower regions defines a cavity;

(c) the middle region comprises a gas disperser positioned within the cavity defined by the middle and lower regions and along the internal side wall of the middle region wherein the gas disperser is constructed with a plurality of support rests positioned intermittently along the length of the gas disperser and is defined by an inner parallel wall facing the inside of the portable tank and exposed to the portable tank contents, and an outer parallel wall, wherein the walls are separated to define a gas region between the walls, wherein the gas inlet connects into the gas region, and further wherein the inner parallel wall comprises perforations; and one or more clean out ports mounted into the side wall of the middle region adjacent to the gas disperser; and (d) the lower region comprises a materials discharge outlet at its lower end.

11. The portable tank of claim 10 wherein support brackets are attached to the outside walls of the middle region for attachment of one or more vibrator or sonicator devices to the portable tank.

12. The portable tank of claim 10 wherein the portable tank is capable of withstanding internal pressure of at least 5 psig.

13. The portable tank of claim 12 wherein the portable tank is capable of withstanding internal pressure of at least 20 psig.

14. The portable tank of claim 10 wherein the gas outlet is provided at about 180° from the gas inlet.

15. The portable tank of claim 10 wherein the gas disperser extends beyond the middle region into the lower region.

16. The portable tank of claim 10 wherein the discharge outlet comprises a flange and valve assembly.

17. The portable tank of claim 16 wherein the valve is a sliding gate valve, a ball valve, or a plug-type valve.

18. The portable tank of claim 10 wherein one or more gas sparge nozzles are mounted on the side walls of the lower region and extend through the walls and into the portable tank.

19. The portable tank of claim 10 wherein the gas disperser is curved.

20. The portable tank of claim 10 wherein the gas disperser forms a chord.

21. A method to dry iodine comprising (a) providing a portable tank as described in claim 1 wherein the contents of the portable tank comprise iodine contaminated with water; (b) introducing a dry gas into the portable tank through the gas inlet and gas disperser; (c) discharging gas from the portable tank through the gas outlet.

22. The method of claim 21 wherein the dry gas is dried air, nitrogen or mixtures thereof.

* * * * *